United States Patent [19]

Maier, Jr.

[11] 4,402,168

[45] Sep. 6, 1983

[54] PANEL CONNECTION

[76] Inventor: Adolph J. Maier, Jr., 128 W. Livingston Pl., Metairie, La. 70005

[21] Appl. No.: 214,268

[22] Filed: Dec. 8, 1980

[51] Int. Cl.[3] ..... E04D 3/362

[52] U.S. Cl. ..... 52/478; 52/748

[58] Field of Search ..... 52/748, 582, 543, 520, 52/489, 762, 288, 282, 478; 403/278

[56] References Cited

U.S. PATENT DOCUMENTS

| | | | |
|---|---|---|---|
| 2,735,383 | 2/1956 | Gerbracht | 52/478 |
| 3,590,543 | 7/1971 | Heirich | 52/520 X |
| 3,708,943 | 1/1973 | Thomas | 52/478 X |

*Primary Examiner*—J. Karl Bell

*Attorney, Agent, or Firm*—Cushman, Darby & Cushman

[57] ABSTRACT

Roofing or wall panels are installed and connected together edge-to-edge with the aid of a special mounting clip and a seam strip. The mounting clip is attached to the seam strip and to the supporting structure of the roof, and during installation the seam strip becomes locked to an edge of each of two panels. The mounting clip is a two-piece assembly having a connecting portion adapted to cooperate with a complementary portion of the seam strip, the two-piece construction facilitating connection of the clip to the seam strip at any point along the strip and thereafter preventing transverse withdrawal. Locking of the seam strip to the edges of the roof panels is effected by deforming the seam strip into gripping engagement with the panel edges.

4 Claims, 7 Drawing Figures

PANEL CONNECTION

This invention relates to a mounting clip for mounting roof or wall panels to a supporting structure and to a method of installing roof or wall panels using the clip and using a seam strip which connects adjacent panels in edge-to-edge relationship.

BACKGROUND OF THE INVENTION

Industrial buildings are frequently constructed with roof and/or wall panels secured to an underlying supporting structure. The panels, often in the form of metal sheets of aluminum or aluminum alloy can be arranged with their adjacent edges overlapped or they can be arranged edge-to-edge. The present invention is concerned with the latter type of construction. In particular the invention contemplates a panel installation system in which the panels are joined to each other by a seam strip which is mechanically connected to an edge of each of two panels. While seam-connected panels of this kind are not new per se, the applicant is not aware of a wall or roof system which employs the seam strip as part of the means for mounting the panels to a supporting structure.

An example of an edge-to-edge joining technique is disclosed in U.S. Pat. No. 3,741,593 issued to Andrew J. Toti. That technique employs an elongated metal seam strip having oppositely facing longitudinal slots therein for receiving the edges of two adjacent panels. After insertion of the panel edges into the slots the slam strip is deformed into clamping engagement with the panel edges such that the panel edges also become deformed and are thus tightly required to the seam strip.

SUMMARY OF THE INVENTION

The present invention provides a special mounting clip for mounting seam-connected roof or wall panels to an underlying supporting structure. The clip is easily and rapidly attachable to the seam strip by virtue of a tongue and groove connection which is so constructed that the clip, once it is connected to the seam strip, prevents relative transverse movement. In particular, the mounting clip is a two-piece assembly, each piece being adapted to be inserted into a slot in the seam strip by transverse movement relative to the slot. The two pieces when engaged with each other within the slot provide a connecting portion having a contour which prevents the clip from being withdrawn transversely from the slot. At the same time the clip is longitudinally slidable within the slot to permit minor adjustment. It is not necessary to insert the clip longitudinally into an open end of the slot and then slide the clip to its desired location. The tongue and groove elements can be reversed by constructing the clip pieces to form a slot or groove rather than a tongue but the former construction is preferred from the standpoints of strength and ease of manipulation.

A convenient transverse cross-sectional shape of the connecting portion of the clip and the slot is a T, such that the bar of the T on the connecting portion resides within a complementary portion of the slot, with the body of the T projecting from the slot for attachment to the supporting structure. The body of the T may be formed by a planar portion of each clip piece, and the bar of the T may be formed by a lip on the free end of each planar portion. When the clip pieces are in engagement with each other, their planar portions overlie each other and the lips project in opposite directions. The end of the clip opposite the connection portion is adapted to be secured to the supporting structure. A flange projecting parallel to the bar of the T may be provided for engaging a surface of the supporting structure.

The invention also provides a method of mounting panels on a supporting structure, the method including the steps of attaching an edge of a panel to a seam strip, attaching a plurality of mounting clips as desired above to the seam strip at longitudinally spaced-apart locations, attaching the mounting clips to the supporting structure, and attaching an edge of another panel to the seam strip. In the preferred embodiment the steps of attaching the seam strip to the edges of the panels is carried out by inserting the panel edges into respective slots in the seam strip and deforming the seam strip into clamping engagement with the edges. This operation is initially performed at spaced-apart locations along the length of the seam strip to form temporary attachments during placement of the panels. Subsequently the seam strip is deformed along essentially its entire length to form a strong, water tight joint with each panel edge. The techniques described in the aforesaid Toti patent 3,741,593 may be employed for this purpose.

The tongue and groove type connections between the seam strip and the mounting clips permit longitudinal sliding movement of the panels relative to the clips. This feature allows thermal expansion and contraction of the roof to occur without stressing the connections between the panels and the supporting structure. The connecting portions of the clips may be coated with graphite as a lubricant.

DETAILED DESCRIPTION

Figure 1:
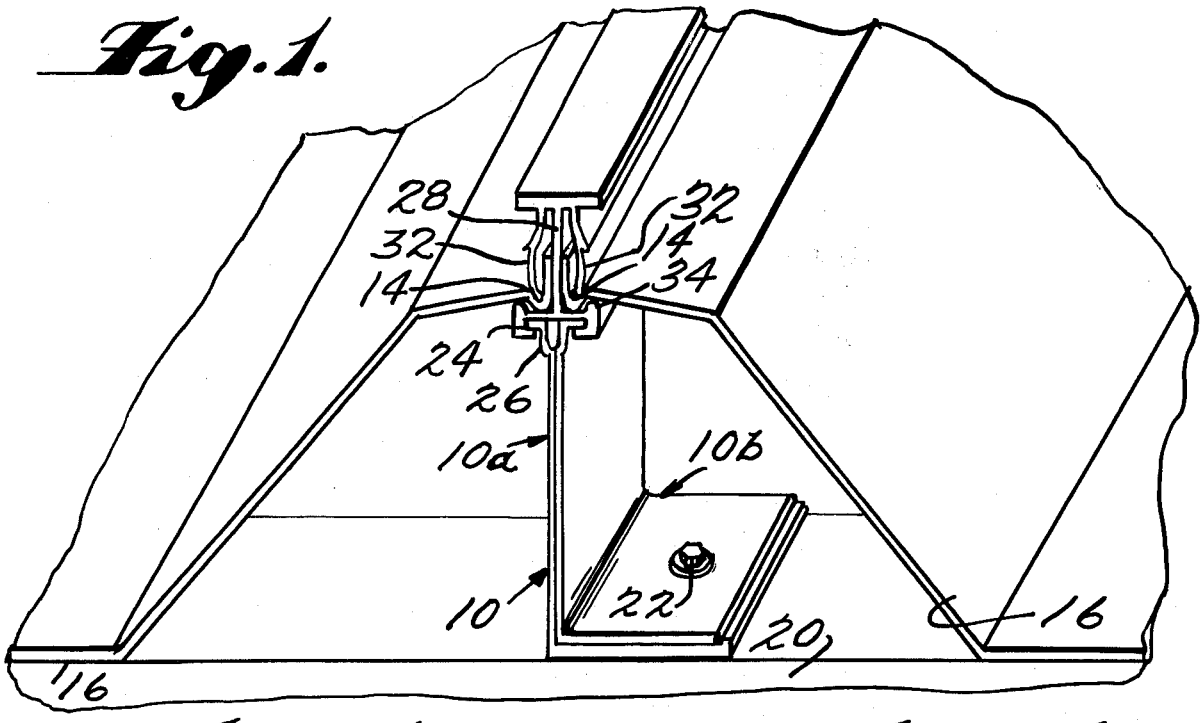
FIG. 1 is a perspective assembly view illustrating the attachment of a completed joint between two panels to an underlying supporting structure, the joint including a seam strip and a mounting clip.

FIG. 1 illustrates a completed joint between two panel edges, together with a mounting clip 10 which embodies the principles of the present invention. The joint is formed by a seam strip 12, such as an extruded aluminum strip, which has been deformed along its length so as to tightly clamp an edge 14 of each of two panels 16 within a respective slot 18 (FIG. 2) in the seam strip 12. The base of the mounting clip 10 is secured to a metal roof purlin 20 with a self-tapping screw 22. The upper edge of the clip 10 connects with the seam strip 12 by means of a tongue and groove type contour which prevents movement of the seam strip 12 in a transverse direction relative to the longitudinal dimension of the seam strip. In the illustrated embodiment the tongue and groove connection is formed by slot 24 of T-shaped cross section in the seam strip 12 and by a complementary T-shaped rib 26 on the clip 10.

Figure 2:
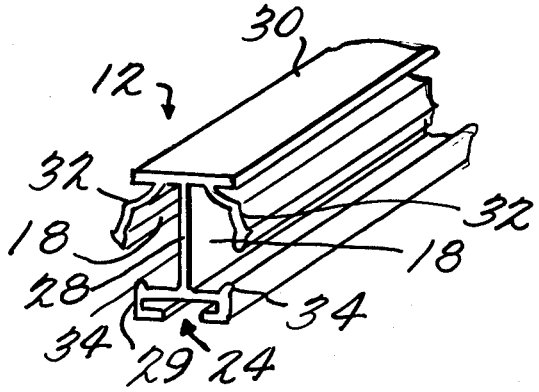
FIG. 2 is a perspective view of the seam strip of FIG. 1 before attachment to the panels.

The seam strip 12, before attachment to the panel edges 14, is shown in FIG. 2. A central vertical web 28 connects a horizontal cap 30 with a foot 29 which forms the T-shaped slot 24. Projecting downwardly from the cap 30 on each side of the web 28 is a wing or jaw 32. The jaws 32 are deformable from their FIG. 2 position inwardly toward the web 28 and downwardly toward the foot 29 to their FIG. 1 position. When a panel edge 14 is inserted into the space 18 between a jaw 32 and the web 28 before deformation of the jaw 32 and the jaw is subsequently deformed, the panel edge 14 becomes tightly clamped between the lower end of the jaw and the upper surface of the foot 29. An upstanding rib 34 on the foot 29 aids in the clamping action.

Figure 3:
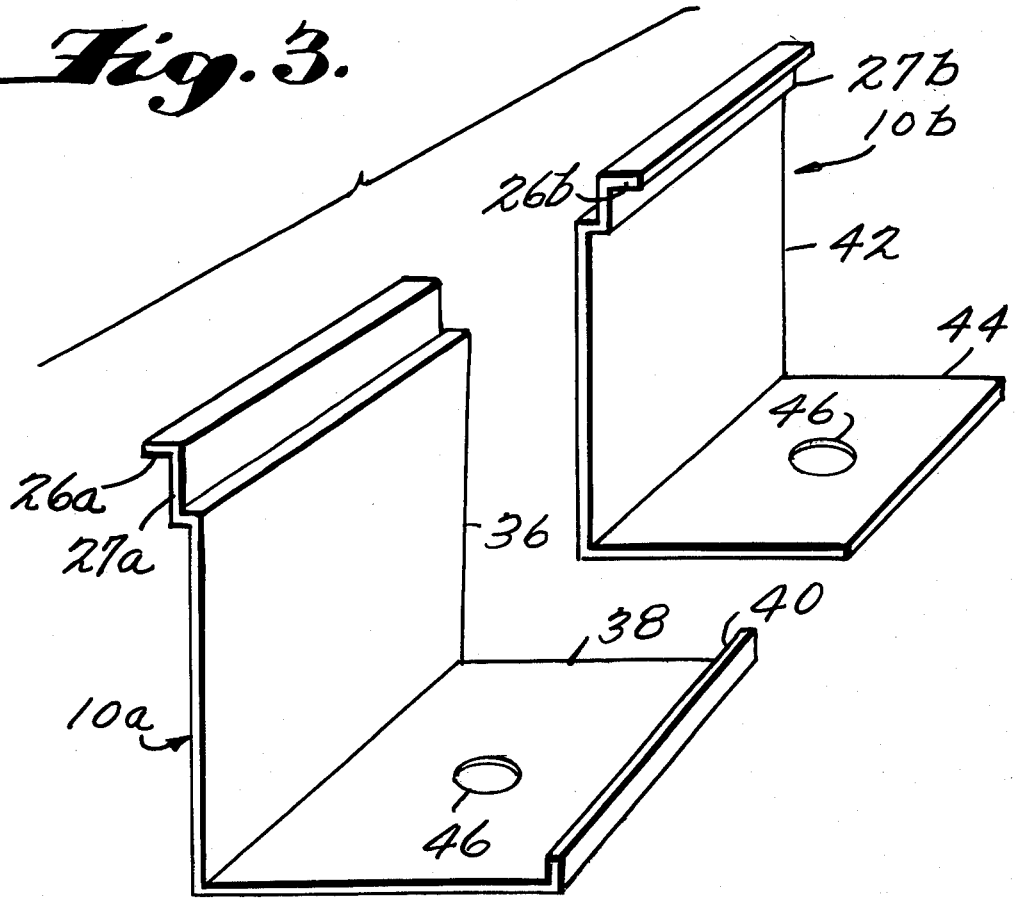
FIG. 3 is a perspective exploded view of the mounting clip of FIG. 1.

The clip 10, as shown in detail in FIG. 3, is a two-piece assembly consisting of two generally L-shaped plates 10*a* and 10*b* which can be nested together in overlying relationship. The lower plate 10*a* includes a vertical planar body 36 and a horizontal planar base or foot 38 which terminates in an upstanding lip 40. The upper plate 10*b* similarly includes a body 42 and a base or foot 44. The foot 44 is slightly shorter than the foot 38 so that when the plates 10*a* and 10*b* are nested as shown in FIG. 1 the outer end of the foot 44 rests against the lip 40 on the foot 38. A hole 46 in each foot 38 and 44 receives the screw 22 shown in FIG. 1.

The T-shaped rib 26 (FIG. 1) of the assembly clip 10 is formed by a horizontally projecting lip 26*a* on the plate 10*a* and an oppositely directed horizontal lip 26*b* on the plate 10*b*. These lips project from spaced-apart portions 27*a* and 27*b* of the plates 10*a* and 10*b*, this spacing ensuring that the rib 26 is of sufficient length to prevent its removal from the slot 24 is a transverse direction.

Figure 4:
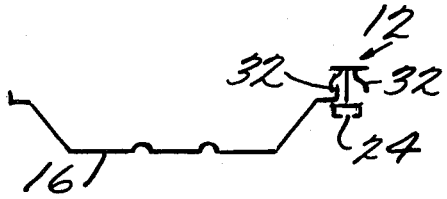
FIGS. 4, 5, 6 and 7 are schematic views illustrating the sequence of steps by which the joint of FIG. 1 is formed.

The use of the clip 10 is installing the panels 16 is illustrated in FIGS. 4, 5, 6 and 7. In the first step, as shown in FIG. 4, a jaw 32 of the seam strip 12 is placed over an edge 14 of a panel 16. The jaw 32 is then squeezed, pinched or crimped closed on the panel edge 14 at intervals along the length of the seam strip 12 to form a temporary connection. This operation can be carried out either on the ground or on the roof, using a hand pincher type of tool constructed for the purpose. Typically the connections can be made at intervals of five feet.

The panel 16 with the seam strip 12 temporarily attached thereto is then placed on the roof supporting structure, and the mounting clips 10 are engaged with the seam strip 12. The latter operation is carried out by separately inserting each clip plate 10*a* and 10*b* into the T-shaped slot 24 in the seam strip. The horizontal dimension of each lip 26*a*, 26*b* is sufficiently small to permit its direct insertion into the slot 24 at the desired location in a direction transverse to the slot. Yet when the two plates 10*a* and 10*b* are nested within the slot 24, the horizontal dimension of T-shaped rib 26 formed by the lips 26*a* and 26*b* prevent transverse withdrawal of the clip 10 from the slot 24, shown in FIG. 1. Thus it is not necessary to insert the clips 10 longitudinally into the open end of the slot 24 and then slide them to the desired locations. The ability to insert the clips 10 directly into the slot 24 at the desired locations is a distinct advantage inasmuch as the panels 16 and hence the seam strip 12 may very long, for example 100 feet long.

Either one of the clip plates 10*a* or 10*b* may be inserted into the slot 24 first by simple linear movement of the respective lip 26*a* or 26*b* in a transverse direction. The other plate can then be inserted in either of two ways. It can be positioned longitudinally of the already inserted plate, moved transversely into the slot 24 and them moved longitudinally in the slot 24 into nesting relationship with the already inserted plate. Alternatively, the second plate can be arranged at an angle to the already inserted plate and coextensive therewith. The lip is inserted transversely into the slot 24 and then this plate is rotated about the axis of the lip into nesting engagement with the already inserted plate.

Figure 5:
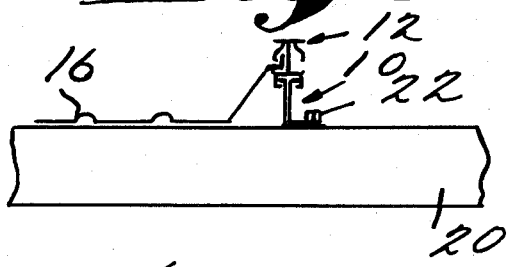

Next, as shown in FIG. 5, the clip 10 is secured to the purlin 20 with a screw 22.

Figure 6:
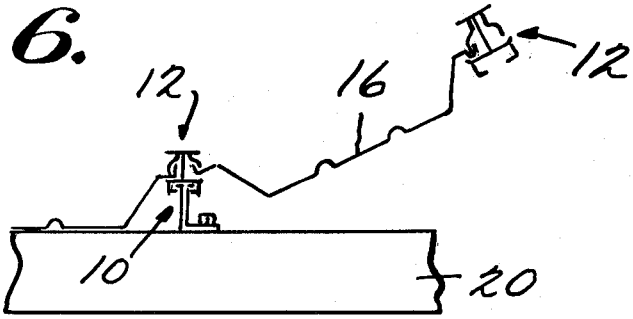

Next, as shown in FIG. 6, an edge 14 of another panel 16 is fitted to the seam strip 12 by inserting the edge 14 into the space 18 between the web 28 and the opposite jaw 32. This jaw 32 is then squeezed onto the edge 14 at intervals in the manner described above with respect to FIG. 14. The opposite edge 14 of this panel will have had another seam strip 12 previously attached thereto.

Figure 7:
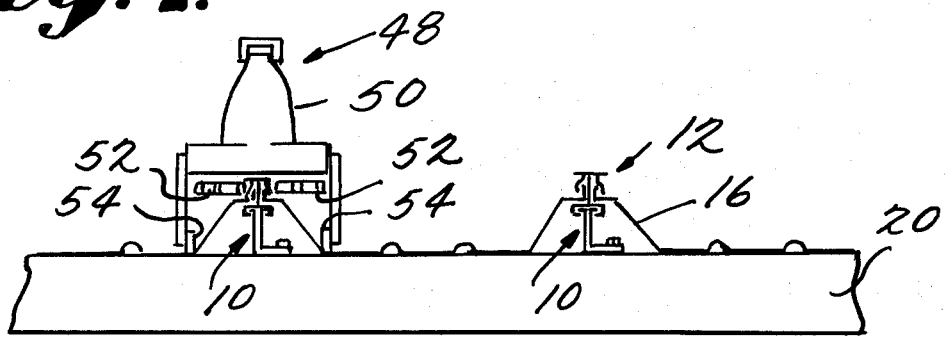

Next, as shown in FIG. 7, the two jaws 32 are closed along the entire length of the seam strip 12 to form a water tight seal between the two panels 16 and to provide rigidity. This can be accomplished with a power driven tool 48 such as that illustrated in FIG. 7. The tool 48 includes an electric motor 50 which drives a pair of crimping rollers 52 mounted in the tool for rotation about vertical axes. During rotation the rollers 52 engage the jaws 32 and deform them into tight engagement with the respective panel edges 14 and simultaneously the rollers 52 cause the tool 48 to move along the seam strip 12. The tool 48 is supported at the correct height by wheels 54 which ride on the panels 16. Typically the seam strip between each two panels will be crimped in this manner as the roofing operation progresses. Crimping of the jaws 32 may also cause deformation of the panel edges or, as shown, the panel edges may be pre-formed to the desired contour in which case no deformation occurs.

Typically the seam strip 12, the clips 10 and the panels 16 will be made of extruded aluminum or aluminum alloy. The material of construction is not critical provided that the necessary tightness and strength of the seam is achieved. The rib portion 26 of the clips 10 can be coated with graphite to reduce friction with the panel edges 14 during thermal expansion and contraction of the panels 16. Preferably the panels are profiled to increase their rigidity . In the illustrated embodiment it is convenient to locate the mounting clips 10 within a channel formed by the panel edges.

I claim:

1. A mounting clip for mounting roof and wall panels to a supporting structure comprising first and second L-shaped plates each having a body and a foot, the body of the first plate having an outer end portion offset from the remainder of the body in the direction of the respective foot and parallel to said remainder of the body so as to form a shoulder at the juncture of said offset portion and said remainder, the outer end portion having a lip projecting from its outer end in the same direction as and generally parallel to the respective foot and the body of the second plate having an outer end portion offset from the remainder of the body in the opposite direction of the respective foot and parallel to said remainder of the body so as to form a shoulder at the juncture of said offset portion and said remainder, the outer end portion having a lip projecting from its outer end generally parallel to the respective foot and in the opposite direction from said foot, said plates being sized so that one plate can nest with the other plate and when so nested, the bodies and lips form a T-shaped in cross section with a space between said outer end portions.

2. A roof or wall assembly comprising: two roof or wall panels each having a straight edge arranged parallel to the straight edge of the other panel; a seam strip overlying and extending along said edges and mechanically deformed into clamping engagement with said edges, said seam strip including a portion located on the opposite side of said panels from said seam strip, said portion defining a T-shaped slot; and a plurality of mounting clips for mounting said seam strip and panel edges to a roof or wall supporting structure, each of said clips comprising two L-shaped pieces in nesting relationship and together forming a portion connectable to a roof or wall supporting structure and also forming a T-shaped portion engaging with said T-shaped slot in a manner to prevent removal from said slot in a transverse direction while permitting longitudinal movement of said seam strip and panels relative to said clips.

3. A method of installing roof or wall panels in edge-to-edge relationship on a supporting structure comprising in the following sequence: attaching an edge of a panel to an elongated same strip at a plurality of longitudinally spaced-apart locations by deforming the seam strip into gripping engagement with the edge at said locations; inserting into a longitudinal groove in the seam strip a plurality of longitudinally spaced-apart mounting clips; attaching the mounting clips to the supporting structure; attaching an edge of another panel to the seam strip at a plurality of longitudinally spaced-apart locations by deforming the seam strip into gripping engagement with the edge at said locations; and deforming the seam strip along essentially its entire length into gripping engagement with the panel edges.

4. A method as in claim 3 wherein the slot in the seam strip is T-shaped and wherein each clip includes two pieces which together form a T-shaped projection for engagement within the slot and wherein each clip is inserted into the groove by separately inserting the two pieces of the clip and then engaging the two pieces with each other to form the T-shaped projection.

* * * * *